United States Patent [19]

Schulz et al.

[11] Patent Number: 5,059,034

[45] Date of Patent: Oct. 22, 1991

[54] CARRIER BAG

[76] Inventors: Günter Schulz, Untere Kellerstr. 64a; Theo Schmidt, Kiefernstr. 7, both of D-8550 Forchheim, Fed. Rep. of Germany

[21] Appl. No.: 308,344

[22] Filed: Feb. 8, 1989

[30] Foreign Application Priority Data

Feb. 18, 1988 [DE] Fed. Rep. of Germany ..... 3805012

[51] Int. Cl.[5] ..... B65D 33/10

[52] U.S. Cl. ..... 383/21; 383/25; 383/29; 229/117.23

[58] Field of Search ..... 383/21, 25, 29, 22, 383/24; 229/52 A, 52 AL, 117.09, 117.23

[56] References Cited

U.S. PATENT DOCUMENTS

| | | | |
|---|---|---|---|
| 1,524,399 | 1/1925 | Krueger | 229/117.23 X |
| 1,733,219 | 10/1929 | Duvall | 383/21 |
| 2,059,643 | 11/1936 | Kobler et al. | 229/117.23 X |
| 2,196,184 | 4/1940 | Belcher | 383/21 |
| 3,023,948 | 3/1962 | Hoeppner | 383/25 |
| 4,119,268 | 10/1978 | Segura | 383/25 |
| 4,277,859 | 7/1981 | Seaman | 383/25 |
| 4,781,474 | 11/1988 | Sengewald | 383/29 |

FOREIGN PATENT DOCUMENTS

| | | | |
|---|---|---|---|
| 0507869 | 11/1954 | Canada | 383/29 |
| 2256994 | 6/1973 | Fed. Rep. of Germany | 229/52 A |
| 2811219 | 9/1979 | Fed. Rep. of Germany | 383/21 |
| 1262658 | 4/1961 | France | 383/29 |
| 2053590 | 4/1971 | France | 383/25 |
| 2131392 | 6/1984 | United Kingdom | 383/29 |

*Primary Examiner*—Stephen Marcus
*Assistant Examiner*—Jes F. Pascua

[57] ABSTRACT

Carrier bag with a closed top surface, in the area of which a handle is provided that is a single-piece construction, the two opposite long ends of which are sealed directly or indirectly to edges of the top surface.

1 Claim, 1 Drawing Sheet

CARRIER BAG

BACKGROUND OF THE INVENTION

The invention relates to a carrier bag with a closed top surface, in the area of which a handle is provided.

Such a handle is supposed to use as little material as possible and be securely attached to the carrier bag; a further requirement is, however, that the outside surface of the side panels is not affected by the handle.

SUMMARY OF THE INVENTION

In the solution to this problem proposed by the invention the handle is a single-piece construction, the two opposite long edges of which are sealed directly or indirectly to the edge of the top surface.

The advantage of a single-piece handle is that it makes even relatively heavy carrier bags comfortable to carry. The way the handle is attached to the top surface in the invention also means that the whole of both of the side panels of the carrier bag is available for display purposes.

In an advantageous embodiment of the invention the two ends of the handle are sealed to the top surface while the handle rests flat on the top surface. This embodiment of the object of the invention is as a result particularly simple to produce and still meets all the requirements.

It is also very advantageous if in accordance with the invention the two long edges of the handle are folded inwards and the outside of the handle in the area of the long edges is sealed to the outside of the top surface.

This design has high visual appeal and has the additional advantage that it effectively permits heavy weights to be carried. When a handle of this design is sealed, a non-sealing element has to be inserted between the folded long edges and the section of the handle above them, so that they do not seal together.

This can, however, also be achieved in accordance with the invention if the inside of the handle is made from a material which does not seal to itself at the temperature required for sealing the handle to the top surface, while the outside is made from a material that seals to the top surface at this temperature.

In a further advantageous embodiment of the invention two comparatively narrow strips are sealed to the top surface and with their free ends are joined to the two ends of the handle by sealing.

When the carrier bag is produced, it is relatively easy to seal narrow strips to the top surface which can then be joined to the actual handle later on.

In a further very advantageous embodiment of the invention a narrow strip is sealed to one end of the top surface while an end of the handle is sealed to the opposite edge, and the other end of the handle is joined to the free end of the strip. Only two parts are required to produce and attach the handle in this case and they are very simple to apply.

BRIEF DESCRIPTION OF THE INVENTION

A number of embodiments of the invention are shown in the drawings:

FIG. 1 is a cross-section of an unfilled carrier bag, with a handle sealed to the top surface, FIG. 2 shows a carrier bag where the ends of the handle are folded inwards, FIG. 3 is a side view of a carrier bag which has two narrow strips sealed to the top surface which in turn are joined to the handle, FIG. 4 is a side view of a further carrier bag, to the top surface of which on the one hand a narrow strip and on the other hand the handle are sealed, both of which are in turn joined by a sealed seam.

DETAILED DESCRIPTION OF THE INVENTION

Figure 1:
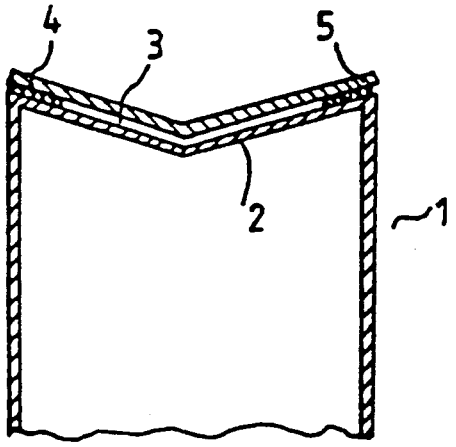

1 in FIG. 1 is a carrier bag made of plastic film which has a top surface 2. An opening is provided at the opposite end for filling the pack and is closed after filling. A handle 3, the two ends 4 and 5 of which are sealed to the top surface 2 when the handle is in a flat position, rests on the top surface. When the carrier bag 1 needs to be carried, the handle 3 is lifted from the top surface so that a hand can be inserted.

Figure 2:
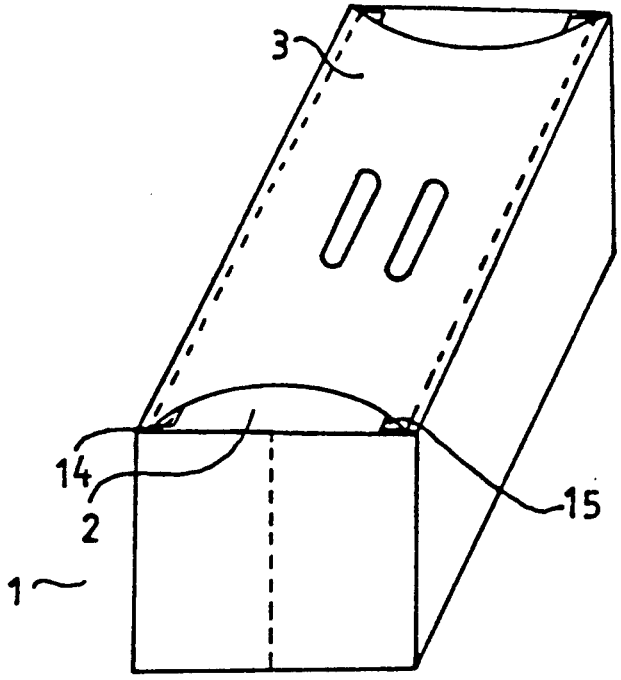

In the embodiment shown in FIG. 2 two opposite ends 14 and 15 of the handle 3 have been folded inwards and then sealed to the top surface 2 underneath. This makes it somewhat easier to lift the handle up off the top surface.

Figure 3:
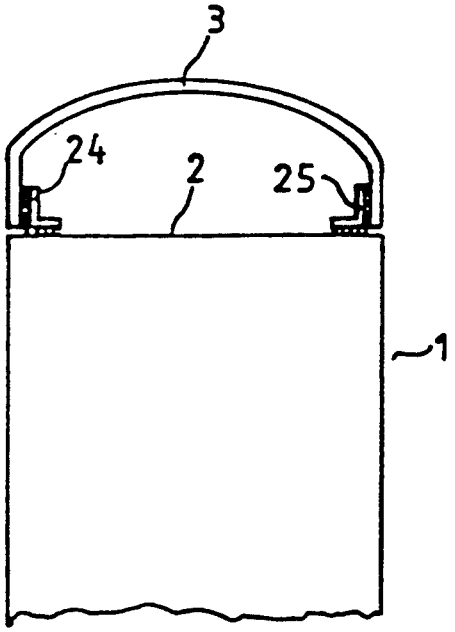

The difference in the embodiment in FIG. 3 is that two narrow strips 24 and 25 are sealed to the top surface 2. The two free ends of the handle 3 are then sealed to the two free ends of these strips—which are shown folded upwards in the Figure.

Figure 4:
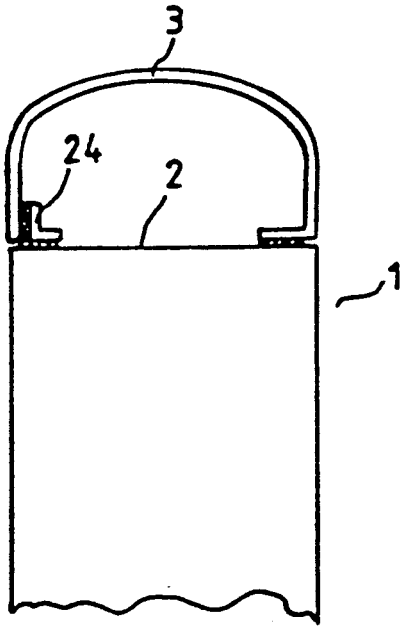

In the embodiment shown in FIG. 4 a narrow strip 24 is sealed to one edge of the top surface 2, while the handle 3 is sealed directly to the opposite edge. The free end of the handle is then sealed to the free end of the strip 24.

What is claimed is:

1. A carrier bag comprising a closed top surface having an outside surface and an inside surface, a handle in the area of said closed top surface, said handle being of a single-piece construction having outside and inside surfaces and two opposite long ends, the two opposite long ends being folded inwardly and the outside surface of said handle in the area of the long edges being sealed directly to the outside of the top surface, the inside surface of the handle being made from a material which does not seal to itself at a temperature required for sealing the outer surface of the handle to the top surface, while the outside surface of the handle is made from a material that seals to the top surface at said temperature.

* * * * *